United States Patent [19]

Stiller et al.

[11] 4,028,613

[45] June 7, 1977

[54] ARRANGEMENT FOR SUPPLYING A LOAD WITH CONTROLLED CURRENT FROM AN ALTERNATING CURRENT SOURCE

[75] Inventors: Armin Stiller; Stefan Borejko, both of Braunschweig, Germany

[73] Assignee: Rollei-Werke Franke & Heidecke, Braunschweig, Germany

[22] Filed: Mar. 26, 1976

[21] Appl. No.: 670,861

Related U.S. Application Data

[63] Continuation of Ser. No. 528,500, Nov. 29, 1974, abandoned.

[30] Foreign Application Priority Data

Dec. 1, 1973 Germany ..... 2360048

[52] U.S. Cl. ..... 323/19; 323/22 SC; 323/24; 323/34

[51] Int. Cl.[2] ..... G05F 5/00

[58] Field of Search ..... 307/252 B, 252 N, 252 T, 307/296, 297; 323/19, 22 SC, 24, 34

[56] References Cited

UNITED STATES PATENTS

| | | | |
|---|---|---|---|
| 3,564,388 | 2/1971 | Nolf | 307/252 N |
| 3,571,696 | 3/1971 | Liska | 323/24 X |
| 3,609,515 | 9/1971 | Babcock et al. | 323/34 X |
| 3,714,547 | 1/1973 | Ross et al. | 323/34 X |
| 3,781,649 | 12/1973 | Ishida | 323/34 X |

*Primary Examiner*—A. D. Pellinen
*Attorney, Agent, or Firm*—Stonebraker, Shepard & Stephens

[57] ABSTRACT

An arrangement for supplying a load with controlled current of a predetermined voltage which remains uniform notwithstanding variations in voltage of the alternating current supply, and notwithstanding differences in the frequency of the alternating current supply. A monostable trigger stage of the switch mechanism is connected to a DC voltage which is proportional to the voltage of the alternating current source, and its resistor which is connected with the capacitive coupling of the trigger stage transistors and determines the reset time of the trigger stage, is connected to a constant DC voltage. The mechanism includes a voltage divider, the division ratio of which is variable by means of a frequency recognition circuit.

26 Claims, 1 Drawing Figure

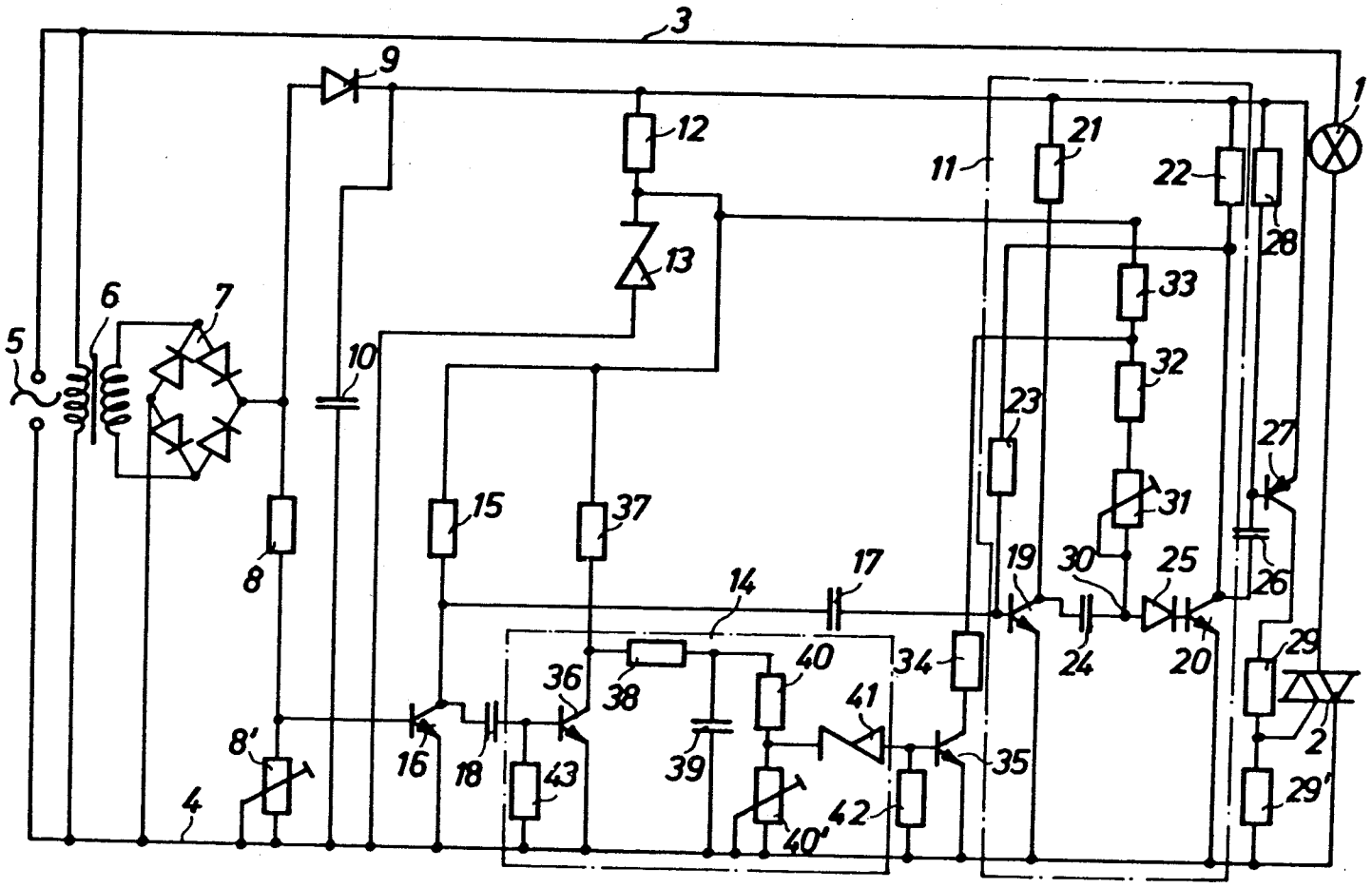
1
2
3
4
5
6
7
8
8'
9
10
11
12
13
14
15
16
17
18
19
20
21
22
23
24
25
26
27
28
29
29'
30
31
32
33
34
35
36
37
38
39
40
40'
41
42
43

ARRANGEMENT FOR SUPPLYING A LOAD WITH CONTROLLED CURRENT FROM AN ALTERNATING CURRENT SOURCE

CROSS REFERENCE TO RELATED APPLICATION

This application is a continuation of application Ser. No. 528,500, filed Nov. 29, 1974 now abandoned.

BACKGROUND OF THE INVENTION

The present invention relates to a switch arrangement or mechanism for supplying a load with current from an alternating current source, by means of phase shift control of the alternating voltage, the switch mechanism having anti-parallel thyristors connected in series with the load, and a monostable trigger stage controlling the thyristors. Such switch arrangements are used primarily for the low-loss reduction of the line voltage to the operating voltage of the load.

In one known switch mechanism of the above mentioned type, the monostable trigger stage is supplied with voltage via a capacitor which is connected in parallel in each case to a thyristor. The input of the monostable trigger stage is connected via a variable threshold resistor into the charging circuit of the capacitor. As a result of the variable threshold resistor the switching arrangement can be so adjusted that the load is fed its predetermined operating voltage regardless of the amount by which the line voltage exceeds the operating voltage of the load.

The disadvantage of this switch arrangement is that after connection of the switch mechanism to a line voltage having an effective value lying above the operating voltage of the load, the switch arrangement must first of all be adjusted by means of the variable resistor so that the operating voltage of the load is reached. Upon transfer to a current supply source of a different line voltage, a readjustment of the switch arrangement must be effected in order to feed the load with its proper operating voltage. Furthermore, this switch arrangement cannot produce a uniform load voltage when there are variations in the line voltage, as the load voltage will vary in the same ratio as the line voltage.

A first object of the invention, therefore, is to create a switch arrangement of the general type above mentioned, which makes it possible, without switching or special adjustment, to connect the load to various supply lines of different line voltages and yet supply the load with a constant operating voltage.

A second object of the invention is to provide switch mechanism of the general type above mentioned, so designed as to make it possible to use the switch mechanism with alternating current sources of different frequencies, while nevertheless providing an output of operating current of a constant or uniform voltage, notwithstanding variations in frequency or variations in voltage of the alternating current supply, and without requiring any special switching or adjustment on the part of the user of the switch mechanism.

It will be readily appreciated that switch mechanism accomplishing these objects will be very beneficial and desirable, for it will enable an appliance requiring a predetermined supply voltage to be used in various different countries or locations where the available alternating current supply has different voltages or different frequencies or both, so that the user may simply plug his switch mechanism and its connected appliance or load into an available alternating current supply socket or outlet, without having to determine first what voltage or what frequency is provided by the outlet, and without danger of damage to his appliance or load.

SUMMARY OF THE INVENTION

The first mentioned object is achieved by providing a circuit in which the monostable trigger stage of the switch arrangement is connected to a DC voltage which is proportional to the line alternating voltage and its resistor which is connected with the capacitive coupling of the trigger stage transistors and determines the reset time of the trigger stage is connected to a constant DC voltage.

The second mentioned object is achieved by constructing the circuit so that the resistor which is connected with the capacitive coupling of the trigger stage transistors and determines the reset time of the trigger stage is developed as a voltage divider, the division ratio of which is variable by means of a frequency recognition circuit. As a further development of the invention, the central tap of the voltage divider is connected via a transistor controlled by the frequency recognition circuit, to the negative pole of the DC voltage feeding the trigger stage. The frequency recognition circuit is so designed that the transistor conducts at the lower frequency so that the divider ratio of the voltage divider is changed in such a manner that the reset time of the monostable trigger stage from the metastable state to the stable state is increased.

By combining the features which accomplish the first object with the features which accomplish the second object, it is possible to obtain a switching arrangement characterized by the fact that the monostable trigger stage is connected to a DC voltage which is proportional to the line alternating current voltage and its resistor which is connected with the capacitive coupling of the trigger stage transistors and determines the reset time of the trigger stage is developed as a voltage divider and connected to a constant DC voltage, the division ratio of the voltage divider being variable via a frequency recognition circuit.

In this way, the result is obtained that the load which is designed for a given operating voltage can be operated on power lines of different voltage and different frequencies without a switching or readjustment having to be made. The switch mechanism of the present invention thus makes it possible, for instance, to connect a load having an effective operating voltage of 90 volts to alternating current power lines whose effective voltage is in the range of 100 to 140 volts, or to a power line which has voltage variations of from 100 to 140 volts. The same load can be operated with this switching arrangement, on AC voltage lines with frequencies of 50 Hz or of 60 Hz.

As a further development of the invention, there is provided a threshold value switch from the output of which an electric signal can be obtained below a predetermined voltage value of the DC voltage feeding the trigger stage. This electric signal is connected via a capacitive coupling to the input of the monostable trigger stage and also connected, via another capacitive coupling, to the input of the frequency recognition circuit which is connected to a constant DC voltage. The frequency recognition circuit, in one suitable further development of the invention, has a capacitor which can be charged from the source of DC voltage via a resistor and discharged via a transistor controlled by the electric signal and which lies above a threshold value former at the base of the transistor controlled by the frequency recognition circuit.

BRIEF DESCRIPTION OF THE DRAWING

The single view is a schematic wiring diagram of switch mechanism in accordance with a preferred embodiment of the invention.

DESCRIPTION OF THE PREFERRED EMBODIMENT

The load indicated schematically at 1 is connected in series with a triac 2 and, by current conductors 3 and 4, to an alternating voltage supply source 5, this source being, for example, a conventional outlet connected to supply mains. Between the conductors 3 and 4 there is connected the primary winding of a transformer 6 whose secondary winding is connected to the input of a full wave rectifier bridge circuit 7. To the output of the bridge circuit 7 there is connected a voltage divider formed by the resistors 8 and 8'. In parallel with this voltage divider is the series connection of a diode 9 and a filter capacitor 10. The supply voltage of the monostable trigger stage indicated in general by the dot-dash outline 11 is taken from a point between the diode 9 and capacitor 10, as shown.

Parallel to the capacitor 10 there is a series connection of a resistor 12 and a Zener diode 13. The Zener diode 13 supplies a constant DC voltage for the supplying of the frequency recognition circuit indicated in general by the dot-dash outline 14. Parallel to the Zener diode 13 there is a series connection of a resistor 15 and the collector-emitter path of an NPN transistor 16. The base of the transistor 16 is connected to the central tap of the voltage divider 8, 8'. The resistor 8' of the voltage divider is preferably variable, for the purpose of adjustment. The collector of the transistor 16 is connected through a capacitor 17 to the input of the monostable trigger stage 11, and also connected through a capacitor 18 to the input of the frequency recognition circuit 14.

The monostable trigger stage 11 comprises, in known manner, a transistor 19 and a transistor 20, the respective collectors of which are connected through respective resistors 21 and 22 with the cathode of the diode 9 and with the positive plate of the capacitor 10. The collector of the transistor 20 is also connected through a resistor 23 with the base of the transistor 19. The collector of the transistor 19 is connected through a capacitor 24 and a diode 25 to the base of the transistor 20. The collector of the transistor 20 is connected through a capacitor 26 to the base of a PNP transistor 27, the base of this transistor also being connected through a resistor 28 with the emitter of the transistor 27. The emitter of the transistor 27 is also connected to the positive plate of the filter capacitor 10, and the collector of the transistor 27 is connected through a voltage divider 29, 29' to the negative plate of the filter capacitor 10. The central tap of the voltage divider 29, 29' is connected to the control electrode of the triac 2.

The capacitive coupling of the transistors 19 and 20 of the monostable trigger stage is connected at the point 30 to the cathode of the Zener diode 13 through a voltage divider circuit having the resistors 31, 32, and 33. The resistor 31 is made variable for adjustment purposes. The junction between the resistors 32 and 33 is connected with the negative output of the bridge circuit 7 through a resistor 34 and the collector-emitter path of an NPN transistor 35 which is controlled by the frequency recognition circuit 14.

The frequency recognition circuit comprises a transistor 36 whose collector-emitter path in series with a resistor 37 is connected in parallel to the Zener diode 13. The base of this transistor 36 is connected with one plate of the previously mentioned capacitor 18, the other plate of which is connected to the collector of the transistor 16. Parallel to the collector-emitter path of the transistor 36 is a series connection of a resistor 38 and a capacitor 39. A voltage divider having resistors 40 and 40' is connected in parallel with the capacitor 39. The central tap of this voltage divider is connected through a Zener diode 41 with the base of the transistor 35. The Zener diode 41 and voltage divider 40, 40' represent a threshold value former whose threshold can be adjusted by the variable resistor 40'. The bases of the transistors 35 and 36 are connected through resistors 41 and 43, respectively, to the negative output of the bridge circuit 7, so that there bases are definitely blocked upon failure of the control.

The operation of the switch mechanism of the present invention is as follows:

At the output of the full wave rectifier bridge circuit 7, there are positive sine half waves which pass through the voltage divider circuit 8 to the base of the transistor 16 and make the latter conductive. The voltage divider 8, 8' is so dimensioned that below a given voltage value of the positive sine half waves at the output of the bridge circuit, the transistor 16 blocks and does not conduct. The potential at the collector of the transistor 16 thus increases and the rate of change of the rise in potential is fed via the capacitors 17 and 18 to the monostable trigger stage 11 and the frequency recognition circuit 14, respectively.

In stable condition, the transistor 20 of the monostable trigger stage 11 is always conductive, since its base is connected to positive potential of the Zener diode 13 through the resistors 31, 32, and 33. Thus the base of the transistor 19 is connected through the resistor 23 with the negative output of the bridge circuit 7, so that the NPN transistor 19 definitely blocks, that is, is nonconductive. At the capacitor 24 a voltage is present from the collector of the transistor 19 to the base of the transistor 20, the value of this voltage being determined by the voltage at the capacitor 10 minus the forward voltage of the diode 25 and of the base-emitter path of the transistor 20.

If the positive pulse caused by the change of potential at the collector of the transistor 16 is now applied to the base of the transistor 19, this transistor 19 becomes conductive and the plate of the capacitor 24 which is connected with the collector of the transistor 19 is connected to the negative output of the bridge circuit 7. The jump in potential is transmitted to the other plate of the capacitor 24 so that the potential of the point 30 drops by the charge voltage of the capacitor 24 below the potential of the negative bridge output. The base of the transistor 20 is thus more negative than the emitter and the transistor 20 blocks until the capacitor 24 has its charge reversed via the resistors 33, 32, and 31 and the base of the transistor again receives potential which is positive with respect to the emitter. In this way the transistor 20 becomes conductive and the transistor 19 becomes blocked.

As the transistor 20 becomes conductive its collector potential decreases and the speed of change of potential brings about, through the capacitor 26, a negative pulse at the base of the PNP transistor 27 so that the latter becomes conductive. A current thus flows over the voltage divider circuit 29, 29' and the voltage which is dropping at the resistor 29' arrives as a firing pulse on the control grid of the triac so that the latter fires and the rear part of a half wave of the alternating current caused by the line voltage flows through the load. Depending on the time at which the firing pulse arrives at the control grid of the triac within a half wave, only a part of the voltage per half wave is present on the load, and a part of the flow of current per half wave is suppressed, as a result of which the effective voltage and current on the load 1 can be increased as desired (up to approximately a full half wave) or reduced as desired (maximum full suppression of the half wave). The time of the driving of the triac is determined by the reset time of the monostable trigger stage from the metastable state to the stable state, and therefore by the time for the reversal in charge of the capacitor 24.

This traditional phase shift control experiences a modification insofar as the reversal in charge of the capacitor 24 takes place via a source of constant voltage while the feed voltage of the monostable trigger stage 11 is reduced or increased corresponding to the voltage or change of voltage in the power line 5. If the switch arrangement is connected to an alternating voltage power line of higher voltage value (or if the voltage in the power line 5 rises), then a higher voltage difference is present at the plates of the capacitor 24 with the transistor 20 conducting and the transistor 19 blocked. With the transistor 19 conducting the potential of the capacitor plate (point 30) connected with the base of the transistor 20 through the diode 25 will thus lie by this larger amount below the potential of the negative bridge output or emitter of the transistor 20. (The diode 25 protects the transistor 20 from unallowably high negative emitter-base voltage.) Since the reversal in charge of the capacitor 24 takes place by the constant voltage at the Zener diode 13 through unvaried resistors 33, 32, 31, the reset time of the monostable trigger stage 11 is lengthened so that a control pulse arrives at the triac 2 and the latter releases a flow of current to the load 1 at a correspondingly later period of time.

In this way with higher voltage a greater part of the sine half wave is suppressed at the load so that the effective value of the voltage of a half wave is independent of the value of the alternating current voltage applied from the line 5. This effect is furthermore slightly supported by the fact that blocking of the transistor 16 takes place near the end of each half wave of the pulsating direct voltage at the output of the bridge circuit 7. Since the transistor 16 blocks below a given voltage valve at the output of the bridge circuit 7, upon an increase of the pulsating DC voltage the time of the blocking of the transistor 16 is shifted more strongly toward the end of the half wave. In this way the transfer of the monostable trigger stage into the metastable condition takes place correspondingly later and regardless of the changed reset time of the monostable trigger stage 11, the time from the start of a voltage half wave until the driving of the triac 2 is lengthened.

If, for instance, the alternating voltage power line 5 has a line frequency of 60 Hz then the transistor 16 is blocked every 8 milliseconds and the pulse which effects the transfer of the monostable trigger stage into the metastable state passes also at the same time over the capacitor 18 to the base of the transistor 36 of the frequency recognition circuit 14. The transistor 36 thus becomes conductive and the capacitor 39 charged to a given voltage through the resistors 37, 38 will discharge over the resistor 38. The charging and discharging of the capacitor 39 takes place corresponding to the driving of the transistor 16 at a time interval of 8 milliseconds. There is thus produced an effective value of given amount at the voltage divider 40, 40'. This voltage divider is so adjusted, by means of the variable resistor 40', that the voltage drop at the resistor 40' is below the Zener voltage of the Zener diode 41. The transistor 35 is at negative potential via the resistor 42, and thus definitely blocks.

If the switch mechanism is now connected to an AC voltage supply 5 having a line frequency of, for example, 50 Hz, the transistor 16 will be driven every 10 ms and the capacitor 39 will be charged and discharged at the same time interval. In this way a voltage having as a whole a higher effective value than when the system is operated with a frequency of 60 Hz is obtained at the voltage divider 40, 40'. The voltage drop at the resistor 40' is now greater than the Zener voltage of the Zener diode 41, so that the base of the transistor 35 is connected to a potential which is positive with respect to its emitter. The transistor 35 thus becomes conductive and the central tap of the voltage divider 31, 32, 33 of the monostable trigger stage 11 is connected via the resistor 34 to the negative output of the bridge circuit 7. The pulse at the collector of the transistor 16 has at the same time allowed the monostable trigger stage to flip into its metastable condition. As the transistor 35 becomes conductive the central tap of the voltage divider 31, 32, 33 now shows a lower potential as a result of the division of the voltage via the resistors 33, 32, 31, as compared with the preceding operation at a frequency of 60 Hz, in connection with which the transistor 35 remains blocked, and the charge reversal time of the capacitor 24 and thus the reset time of the monostable trigger stage 11 is lengthened. Thus the driving of the triac 2 takes place at a later time within a half wave, which was intended, since with 50 Hz operation the individual half waves are longer than with 60 Hz operation, and therefore the pulse spacing of the individual drive pulses of the triac 2 must be lengthened. As can easily be seen, as a whole the same effective value of the operating voltage is thus obtained for the load, regardless of whether the device is connected to a supply current having a frequency of 50 Hz or of 60 Hz.

What is claimed is:

1. In an arrangement for supplying a load with constant voltage from an AC source of variable voltage amplitude, said arrangement including bidirectional thyristor means in series with said load and said source, a monostable multivibrator arranged for controlling the conductive period of said thyristor means, and means for providing said monostable multivibrator with a rectified voltage proportional to said voltage amplitude of said source, said arrangement comprising:

a. threshold switch means arranged for changing state in response to each half wave of said rectified voltage crossing a predetermined threshold value;

b. said monstable multivibrator being arranged to change to its metastable state in response to said change of state of said threshold switch means;

c. said monostable multivibrator being arranged for supplying a gating pulse to said bidirectional thyristor means for making said bidirectional thyristor means conductive for a portion of each half wave of said AC source upon the return of said monostable multivibrator to its stable state;

d. R-C circuitry for establishing the reset time for said monostable multivibrator to return to its stable state; and e. said R-C circuitry being connected to a constant DC voltage for varying said reset time as a function of said voltage amplitude of said source.

2. The arrangment of claim 1 wherein said threshold switch means includes a voltage divider (8,8') supplied with a rectified voltage from said source and a transistor (16) in circuit with said voltage divider (8,8') and arranged for changing state at a threshold value to provide a signal to said monostable multivibrator (11).

3. The arrangement of claim 2 including a capacitor (17) arranged for coupling said signal from said transistor (16) to the input of said monostable multivibrator (11).

4. The arrangement of claim 2 wherein said transistor (16) is connected with said constant DC voltage, and the base of said transistor (16) is connected with said voltage divider (8,8').

5. The arrangement of claim 1 including a transistor (27), and a capacitor (26) coupling the output of said monostable multivibrator (11) to said transistor (27) whose collector is connected to the control grid of said bidirectional thyristor means.

6. In an arrangement for supplying a load with constant voltage from an AC source of variable frequency, said arrangement including bidirectional thyristor means in series with said load and said source, a monostable multivibrator arranged for controlling the conductive period of said thyristor means, and means for providing said monostable multivibrator with a rectified voltage proportional to said voltage amplitude of said source, said arrangement comprising:

a. threshold switch means arranged for changing state in response to each half wave of said rectified voltage crossing a predetermined threshold value;

b. said monostable multivibrator being arranged to changed to its metastable state in response to said change of state of said threshold switch means;

c. said monostable multivibrator being arranged for supplying a gating pulse to said bidirectional thyristor means for making said bidirectional thyristor means conductive for a portion of each half wave of said AC source upon the return of said monostable multivibrator to its stable state;

d. R-C circuitry for establishing the reset time for said monostable multivibrator to return to its stable state; and e. a frequency-recognition circuit arranged for changing the resistance value of said R-C circuitry for varying said reset time as a function of the frequency of said source.

7. The arrangment of claim 6 including a voltage divider for setting said resistance value of said R-C circuitry, and said frequency recognition circuit being arranged for varying said resistance value of said voltage divider.

8. The arrangement of claim 7 including a transistor (35) controlled by said frequency recognition circuit (14) and the central tap of said voltage divider (31,32,33) being connected to said transistor (35).

9. The arrangement of claim 6, wherein said frequency recognition circuit is connected to a constant DC voltage and is controlled by a DC voltage proportional to said voltage amplitude of said source.

10. The arrangement of claim 6 wherein said threshold switch means includes a voltage divider (8,8') supplied with a rectified voltage from said source and a transistor (16) in circuit with said voltage divider (8,8') and arranged for changing state at said threshold value to provide a signal to said monostable multivibrator (11).

11. The arrangement of claim 10 wherein said frequency recognition circuit includes a capacitor (39), means including a resistor (37) for charging said capacitor (39), means including a transistor (36) for discharging said capacitor (39), said transistor (36) being controlled by said signal from said transistor (16), and a threshold value former (40,40',41), further comprising a transistor (35) controlled by said frequency recognition circuit, the base of said transistor (35) being connected to said capacitor (39) through said threshold value former.

12. The arrangement of claim 11 wherein said threshold value former includes an adjustable voltage divider (40, 40') connected in parallel with said capacitor (39) of said frequency recognition circuit, and said frequency recognition circuit includes a zener diode (41), and there is means connecting an intermediate tap of said voltage divider (40,40') through said zener diode to the base of said transistor (35).

13. The arrangement of claim 10 including a capacitor (17) arranged for coupling said signal from said transistor (16) to the input of said monostable multivibrator (11).

14. The arrangement of claim 13 including a capacitor (18) arranged for coupling said signal from said transistor (16) to the input of said frequency recognition circuit (14).

15. The arrangement of claim 14 wherein said transistor (16) is connected with said constant DC voltage, and the base of said transistor (16) is connected with said voltage divider (8,8').

16. The arrangement of claim 6 wherein said source varies in voltage amplitude, and said R-C circuitry is connected to a constant DC voltage for varying said reset time as a function of said voltage amplitude of said source.

17. The arrangement of claim 16 wherein said threshold switch means includes a voltage divider (8,8') supplied with a rectified voltage from said source and a transistor (16) in circuit with said voltage divider (8,8') and arranged for changing state at a threshold value to provide a signal to said monostable multivibrator (11).

18. The arrangement of claim 17 including a capacitor (17) arranged for coupling said signal from said transistor (16) to the input of said monostable multivibrator (11).

19. The arrangement of claim 18 including a capacitor (18) arranged for coupling said signal from said transistor (16) to the input of said frequency recognition circuit (14).

20. The arrangement of claim 19 wherein said transistor (16) is connected with said constant DC voltage.

21. The arrangement of claim 17 wherein said frequency recognition circuit includes a capacitor (39), means including a resistor (37) for charging said capacitor (39), means including a transistor (36) for discharging said capacitor (39), said transistor (36) being controlled by said signal from said transistor (16), and a threshold value former (40,40', 41), further comprising a transistor (35) controlled by said frequency recognition circuit, the base of said transistor (35) being connected to said capacitor (39) through said threshold value former.

22. The arrangement of claim 21 wherein said threshold value former includes an adjustable voltage divider (40,40′) connected in parallel with said capacitor (39) of said frequency recognition circuit, and said frequency recognition circuit includes a zener diode (41), and there is means connecting an intermediate tap of said voltage divider (40,40′) through said zener diode to the base of said transistor (35).

23. The arrangement of claim 16 including a transistor (27) and a capacitor (26) coupling the output of said monostable multivibrator (11) to said transistor (27) whose collector is connected to the control grid of said bidirectional thyristor means.

24. The arrangement of claim 16 including a voltage divider for setting said resistance value of said R-C circuitry, and said frequency recognition circuit being arranged for varying said resistance value of said voltage divider.

25. The arrangement of claim 16 including a transistor (35) controlled by said frequency recognition circuit (14) and the central tap of said voltage divider (31,32,33) being connected to said transistor (35).

26. The arrangement of claim 16 wherein said frequency recognition circuit is connected to a constant DC voltage and is controlled by a DC voltage proportional to said voltage amplitude of said source.

* * * * *